United States Patent [19]

Gronbech et al.

[11] Patent Number: 4,497,215

[45] Date of Patent: Feb. 5, 1985

[54] HYDRO-MECHANICAL ACTUATOR

[75] Inventors: Robert W. Gronbech; Michael Lister, both of Sheffield, England

[73] Assignee: Davy McKee (Sheffield) Limited, Sheffield, England

[21] Appl. No.: 490,323

[22] Filed: May 2, 1983

[30] Foreign Application Priority Data

May 5, 1982 [GB] United Kingdom ..... 8212896

[51] Int. Cl.[3] ..... F16H 25/20; B21B 31/24; B21B 31/32

[52] U.S. Cl. ..... 74/89.15; 72/248

[58] Field of Search ..... 72/248; 74/89.15, 424.8 R; 82/27, 21 A, 5; 92/140

[56] References Cited

U.S. PATENT DOCUMENTS 3,910,090 5/1974 Lorenz ..... 72/248

*Primary Examiner*—Francis S. Husar

*Assistant Examiner*—Steven B. Katz

*Attorney, Agent, or Firm*—Lee, Smith & Zickert

[57] ABSTRACT

A hydro-mechanical actuator for adjustably positioning a part, for example a roll carriage of a vertical roll mill stand, is described in which an actuating member having a pusher is mechanically driven to approximate a desired position and then is adjustably displaced by a hydraulic mechanism. The actuator member has a threaded portion which engages a threaded nut secured against rotation by keys; hance rotation of the actuating member will cause its axial displacement. Rotation of the actuating member is by a driving splined sleeve which engages a splined portion of the actuating member. The hydraulic mechanism includes a piston which engages with the threaded nut which can move axially with the actuating member, so that the position of the actuating member, and pusher, can be adjusted by controllably varying the pressure applied to either side of the piston in the cylinder.

8 Claims, 3 Drawing Figures

HYDRO-MECHANICAL ACTUATOR

FIELD OF THE INVENTION

This invention relates to a hydro-mechanical actuator for effecting displacement of a part to be positionally adjusted. An example of the use to which such an actuator may be put is the adjustment of a roll of a rolling mill in order to set the roll gap.

BRIEF DESCRIPTION OF THE PRIOR ART

British patent specification No. 1,316,959 discloses in FIG. 1 a hydro-mechanical actuator for a vertical stand of a slabbing mill employing a conventional screwdown with a hydraulic capsule interposed between the screwdown and a roll carriage; the hydraulic capsule was employed for fine modulation of the roll gap after the roll had been brought approximately to the required position by the screwdown.

While the hydro-mechanical actuator of specification No. 1,316,959 is generally satisfactory, it entails a hydraulic capsule located closely adjacent to the roll gap and to the hot metal workpiece, with the attendant fire risk resulting from component failure. Further, the capsule is in a hostile environment in that it is subjected to high pressure descaling water and the scale itself.

In one aspect the present invention provides, a hydro-mechanical actuator. The actuator has an actuating member which has a driving end for effecting displacement of a part to be positionally adjusted. A mechanical driving means causes rotation of the actuating member, without restricting its axial displacement; and an internally threaded member which is held against rotation receives a threaded portion of the actuating member so that rotation of the actuating member by the driving means results in axial movement of the actuating member. A hydraulic mechanism is provided for axially displacing the internally threaded member and hence the actuating member. In that construction, the hydraulic mechanism is separated from the internally threaded member and may be located in an entablature or other housing protecting it from accidental damage.

BRIEF DESCRIPTION OF THE DRAWINGS

Other objects and advantages of the invention will become apparent from the following description with reference to the accompanying drawings, wherein.

DETAILED DESCRIPTION

Figure 1:
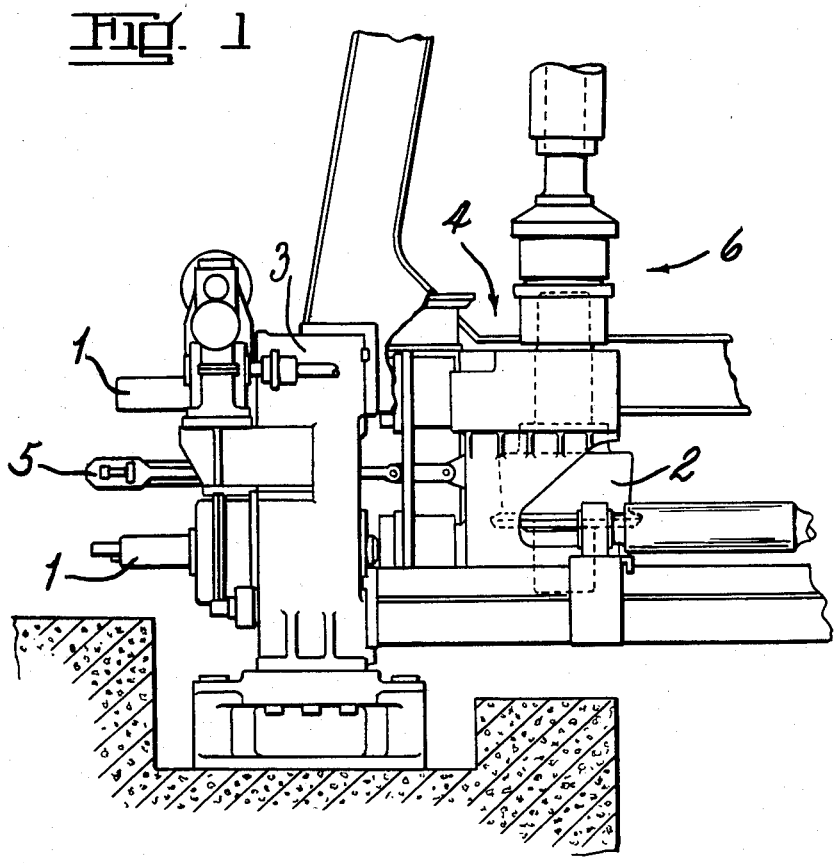
FIG. 1 is a general side view of an adjustment mechanism for a vertical roll, which incorporates the hydro-mechanical actuator.
Figure 2:
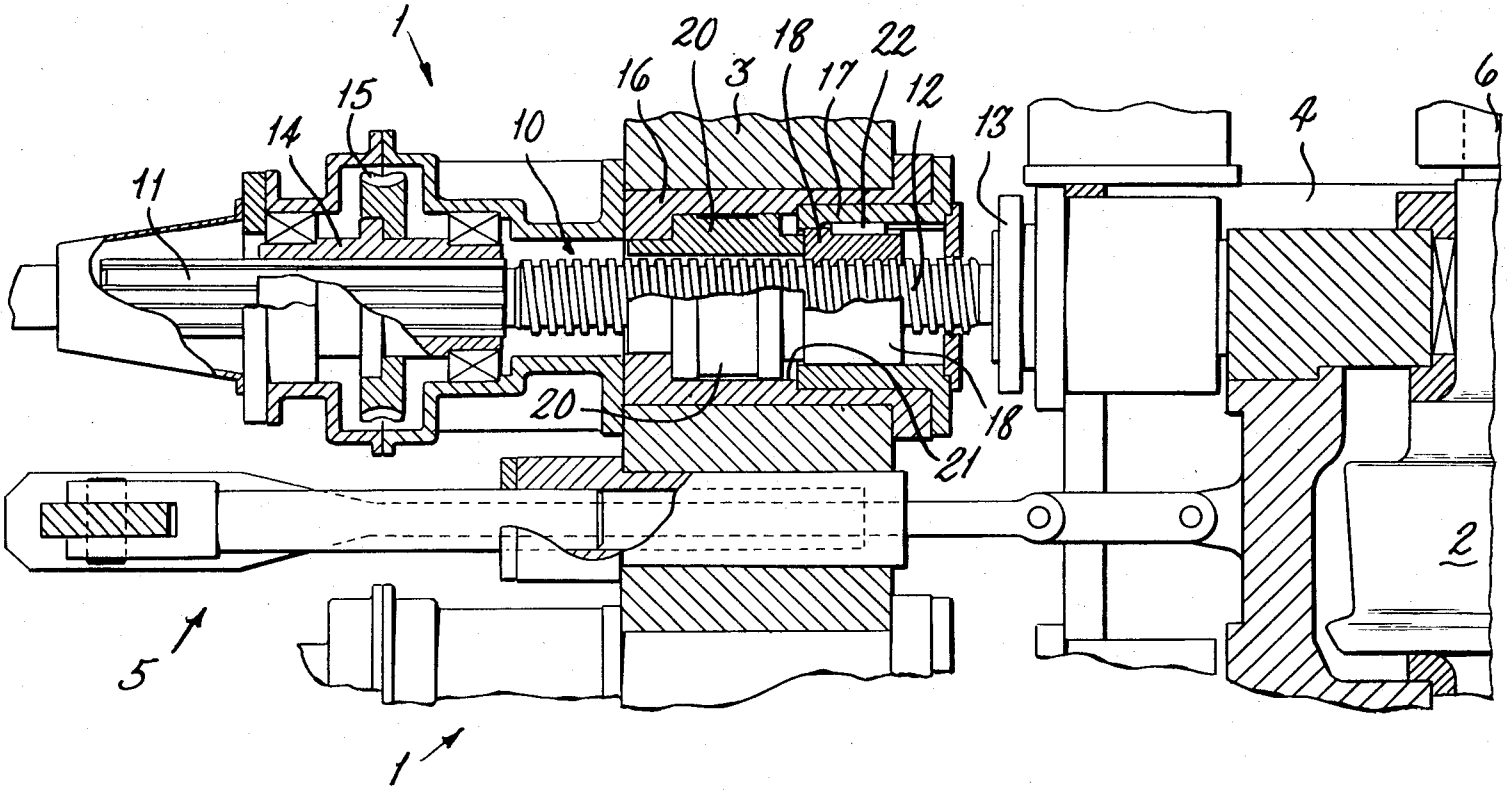
FIG. 2 is an axial section of the hydro-mechanical actuator in a retracted position.
Figure 3:
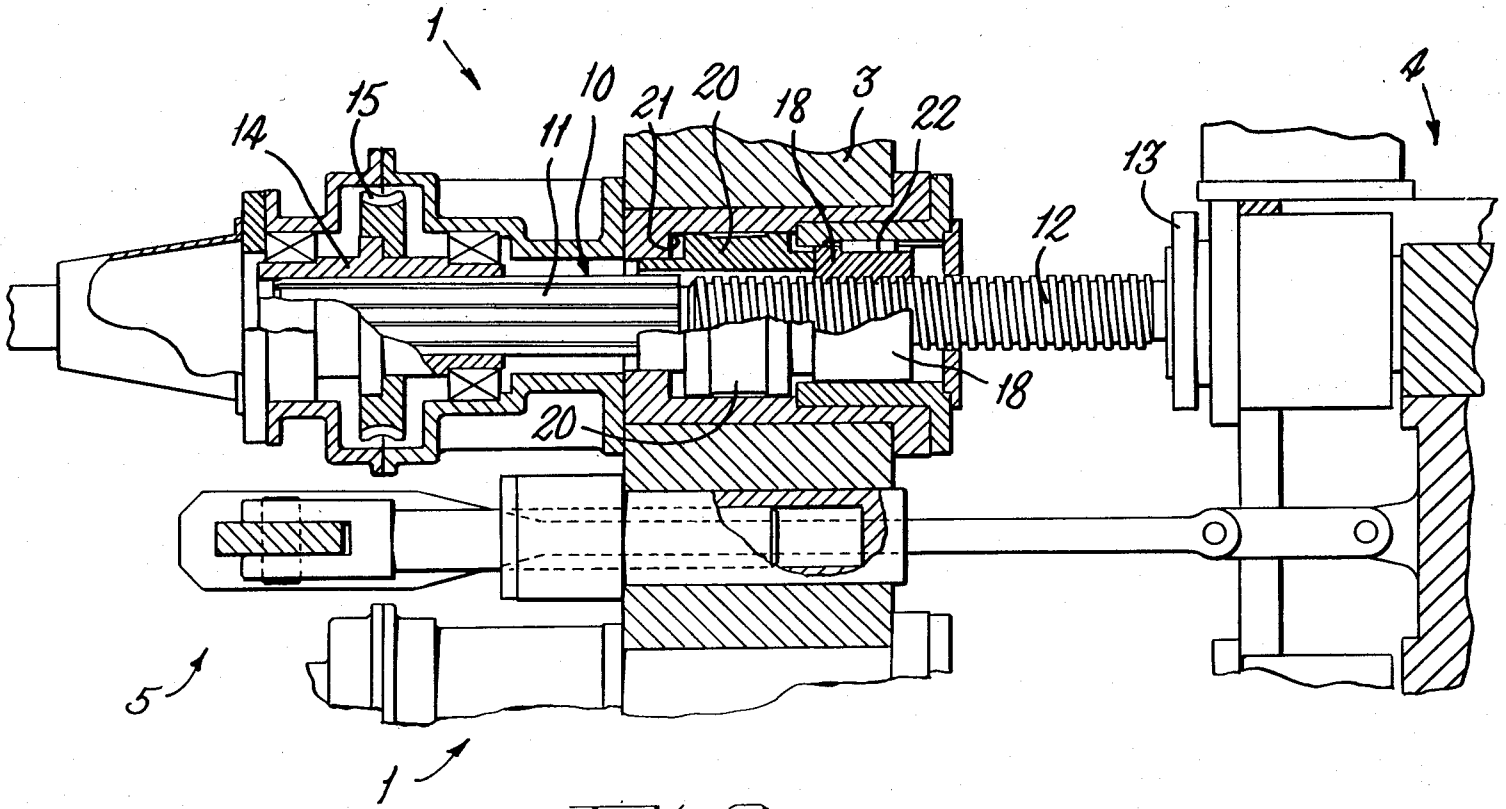
FIG. 3 is an axial section of the hydro-mechanical actuator in an extended position.

The actuator 1 shown in detail in FIGS. 2 and 3 of the drawings is intended for use as the screwdown for a vertical stand of a slabbing mill, as shown in FIG. 1, but may be employed as the screwdown for other mills and in other applications. For a vertical mill, FIG. 1, two screwdowns of actuators 1 are provided for each roll 2 which is driven by a roll drive 6, each passing through an entablature 3 and engaging the roll carriage 4 at spaced points. A pull-back piston and cylinder assembly 5 is arranged between the two screwdowns 1 and is attached to the roll carriage 4, for withdrawing the roll 2 in order to open the roll gap. The actuator 1 comprises a horizontal long stroke screw and a short stroke hydraulic capsule. Thus, referring in particular to FIGS. 2 and 3, the actuator has an actuating member 10 which is splined over its rear (left hand) half 11 and threaded over its forward (right hand) half 12, which carries a pusher 13 engaging against the roll carriage 4. The mechanical drive is through a splined sleeve 14 having a wormwheel 15 driven by a worm (not shown) which engages with the splined half 11 and which rotates the actuating member 10 without restricting its axial movement.

Mounted in the entablature 3 is a sleeve 16 in which is secured a retaining sleeve 17, having internal keys 22 engaging with an internally threaded member in the form of a nut 18 and holding the nut against rotation while permitting it to move axially. The internal thread of nut 18 meshes with the threaded part 12 of the actuating member 10, so that rotation of the latter results in its axial displacement.

The short stroke hydraulic capsule is constituted by a piston 20 surrounding the actuating member 10 without engaging it, and arranged in a cylinder 21 defined by the sleeve 16 and the rear end of retaining sleeve 17. The forward end of the piston 20 abuts against the nut 18. The hydraulic cylinder may be double acting, liquid under pressure being supplied to either end of the cylinder as required.

Displacement of the actuating member 10 is effected by rotating it through the mechanical drive 14 to bring the pusher 13 and therefore the roll to its approximate operating position. Fine adjustment or modulation is then effected by the short stroke hydraulic capsule; for example the supply of liquid under pressure to the rearward (left hand) end of the cylinder 21 drives the piston 20 to the right, axially displacing the nut 18 and hence the member 10 and pusher 13, FIG. 3. Similarly, the roll gap may be increased by reducing the hydraulic pressure when the rolling load drives the actuator member 10, the nut 18 and the piston 20 rearwardly, e.g. FIG. 2.

As will be appreciated, the hydraulic capsule is protected against descaling water and scale by being located within the entablature 3, and is displaced with the actuator member by the hot workpiece being rolled by the mill.

What we claim is:

1. A hydro-mechanical actuator comprises an actuating member which has a driving end for effecting displacement of a part to be positionally adjusted, and has a threaded portion; mechanical driving means for causing rotation of the actuator member, without restricting its axial displacement; an internally threaded member in which the threaded portion of the actuating member is threaded and which is held against rotation, whereby rotation of the actuating member by the driving means results in axial movement of the actuating member; and a hydraulic mechanism including a piston-cylinder assembly which abuts the internal threaded member for axially displacing the internally threaded member and hence the actuating member.

2. A hydro-mechanical actuator as claimed in claim 1 wherein the hydraulic mechanism is arranged on the side of the internally threaded member distant from the driving end of the actuating member.

3. A hydro-mechanical actuator as claimed in claim 1, wherein the hydraulic mechanism is arranged in an entablature or like housing.

4. A hydro-mechanical actuator as claimed in claim 1, wherein the hydraulic cylinder is double acting and the internally threaded member may be displaced in either axial direction.

5. A hydro-mechanical actuator as claimed in claim 1, wherein the piston-cylinder assembly is formed around the actuator member.

6. A hydro-mechanical actuator as claimed in claim 5 wherein the cylinder is at least partly defined by a fixed sleeve and the internally threaded member is keyed into the fixed sleeve.

7. A hydro-mechanical actuator as claimed in claim 1, wherein the internally threaded member is secured against rotation by fixedly mounted keys.

8. A hydro-mechanical actuator as claimed in claim 1, wherein the mechanical driving means includes a driving splined sleeve which engages with a splined portion of the actuating member.

* * * * *